US009505216B2

(12) United States Patent
Koide et al.

(10) Patent No.: US 9,505,216 B2
(45) Date of Patent: Nov. 29, 2016

(54) LIQUID EJECTING DEVICE AND METHOD OF MANUFACTURING LIQUID EJECTING DEVICE

(71) Applicant: BROTHER KOGYO KABUSHIKI KAISHA, Nagoya-shi, Aichi-ken (JP)

(72) Inventors: Shohei Koide, Aichi (JP); Atsushi Ito, Aichi (JP); Kazuo Kobayashi, Kakamigahara (JP); Hiroaki Hiraide, Inazawa (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/826,506

(22) Filed: Aug. 14, 2015

(65) Prior Publication Data

US 2016/0052269 A1 Feb. 25, 2016

(30) Foreign Application Priority Data

Aug. 22, 2014 (JP) ..... 2014-169369
Aug. 22, 2014 (JP) ..... 2014-169458

(51) Int. Cl.
*B41J 2/14* (2006.01)
*B41J 2/16* (2006.01)
*B41J 2/055* (2006.01)

(52) U.S. Cl.
CPC ..... *B41J 2/161* (2013.01); *B41J 2/055* (2013.01); *B41J 2/14233* (2013.01);
(Continued)

(58) Field of Classification Search
CPC ..... B41J 2/1433; B41J 2/14233; B41J 2/161
USPC ..... 347/9, 45
See application file for complete search history.

(56) References Cited

U.S. PATENT DOCUMENTS 6,666,547 B1 12/2003 Takahashi et al.
8,413,377 B2 * 4/2013 Koyama ..... B41J 2/14024 347/29

(Continued)

FOREIGN PATENT DOCUMENTS

JP 2004-255702 A 9/2004
JP 2006-256165 A 9/2006
JP 2007050634 A 3/2007

OTHER PUBLICATIONS

Application as filed in related U.S. Appl. No. 14/832,033, on Aug. 21, 2015.

(Continued)

*Primary Examiner* — Jason Uhlenhake
(74) *Attorney, Agent, or Firm* — Merchant & Gould P.C.

(57) ABSTRACT

A liquid ejecting device has a fluid passage structure formed with multiple nozzles and multiple passages respectively communicating with the multiple nozzles. The fluid passage structure has a nozzle plate formed with the multiple nozzles, and a passage body laminated and bonded with the nozzle plate, the passage body being formed with multiple individual passages respectively communicating with the multiple nozzles, the passage body being formed with provided with multiple convex parts made of a material harder than the nozzle plate. The multiple convex parts protruding toward a nozzle plate side, and the multiple convex parts are covered by the nozzle plate. Further, the multiple convex parts protrude with respect to a liquid ejection surface on which ejection openings of the multiple nozzles arranged.

14 Claims, 8 Drawing Sheets

(52) U.S. Cl.
CPC ..... *B41J 2/1623* (2013.01); *B41J 2/1626* (2013.01); *B41J 2/1632* (2013.01); *B41J 2/1634* (2013.01); *B41J 2002/14266* (2013.01); *B41J 2002/14419* (2013.01); *B41J 2002/14459* (2013.01)

(56) References Cited

U.S. PATENT DOCUMENTS

2010/0061000 A1 3/2010 Higuchi
2010/0245478 A1* 9/2010 Uno ..... B41J 2/055 347/47
2011/0057992 A1* 3/2011 Tobita ..... B41J 2/1612 347/54
2013/0242002 A1* 9/2013 Takahashi ..... B41J 2/14233 347/54
2013/0342612 A1* 12/2013 Nakakubo ..... B41J 2/14209 347/71

OTHER PUBLICATIONS

U.S. Office action issued in related U.S. Appl. No. 14/832,033, mailed Jun. 3, 2016.
Office Action issued in related U.S. Appl. No. 14/832,033, on Sep. 19, 2016.

* cited by examiner

LIQUID EJECTING DEVICE AND METHOD OF MANUFACTURING LIQUID EJECTING DEVICE

CROSS-REFERENCE TO RELATED APPLICATION

This application claims priority under 35 U.S.C. §119 from Japanese Patent Applications No. 2014-169369 and No. 2014-169458 both filed on Aug. 22, 2014. The entire subject matters of the applications are incorporated herein by reference.

BACKGROUND

Technical Field

The present disclosures relate to a liquid ejecting device and a method of manufacturing a liquid ejecting device.

Related Art

Conventionally, a liquid ejecting device has been known. An example of such a liquid ejecting device is employed in an inkjet head of an inkjet printer configured to eject ink drops through nozzles formed on the inkjet head. Typically, the inkjet head has a nozzle plate made of synthetic resin (hereinafter, occasionally referred to as plastic) and formed with multiple nozzles, a passage-formed plate made of metal and formed with inflow passages communicating with the multiple nozzles, and piezoelectric elements provided to the passage-formed plate. Such an inkjet head is configured such that the piezoelectric elements apply pressures to ink existing in the ink flow passages to eject the ink drops through the nozzles.

SUMMARY

In the inkjet head as described above, typically, an ink-repellent coat is formed on an ink ejection surface, which is a surface of the nozzle plate and formed with the multiple ink ejection openings, of the plastic nozzle plate at portions surrounding ejection openings of the multiple nozzles in order to prevent the ink resides around the multiple nozzles. Further, according to a conventional inkjet head, two lines of elongated protrusions, which extend in a direction of a nozzle array, are formed on the ink ejection surface of the nozzle plate with each nozzle array arranged therebetween. With the protrusions, when a printing sheet is lifted due to sheet jam or the like during a printing operation, the printing sheet is prevented or suppressed from contacting the ejection openings as it contacts the protrusions. Thus, with this configuration, a peripheral part of each ejection opening or the ink-repellent coat around each ejection opening is prevented from being damaged by the printing sheet.

In the conventional art as described above, the protruded parts are formed on the nozzle plate. Accordingly, the protruded parts are formed of the synthetic-resin. Since the strength of the synthetic-resin is low, the protruded parts have low endurance. As the printing sheet repeatedly hits, the protruded parts may be whittled gradually and finally they may be whittled. If the printing sheet hits the protruded parts with a relatively strong force, a part of the protruded part may be chipped.

In consideration of the above, aspects of the present disclosure provides an improved liquid ejecting device in which protection of areas surrounding liquid ejection openings can be ensured for a long period, and a method of manufacturing such a liquid ejecting device.

According to aspects of the disclosures, there is provided a liquid ejecting device, having a fluid passage structure formed with multiple nozzles and multiple passages respectively communicating with the multiple nozzles. The fluid passage structure has a nozzle plate formed with the multiple nozzles, and a passage body laminated and bonded with the nozzle plate, the passage body being formed with multiple individual passages respectively communicating with the multiple nozzles, the passage body being formed with provided with multiple convex parts made of a material harder than the nozzle plate. The multiple convex parts protruding toward a nozzle plate side, and the multiple convex parts are covered by the nozzle plate. Further, the multiple convex parts protrude with respect to a liquid ejection surface on which ejection openings of the multiple nozzles arranged.

According to aspects of the disclosures, there is also provided a liquid ejecting device, having a fluid passage structure formed with multiple nozzles arranged in a particular nozzle arrangement direction and multiple passages respectively communicating with the multiple nozzles. The fluid passage structure comprises a laminated body including a synthetic-resin nozzle plate formed with the multiple nozzles and a metallic passage body which is laminated and bonded with the nozzle plate and formed with multiple individual passage parts communicating with the multiple nozzles of the liquid passages. Further, the laminated body has a liquid ejection surface on which multiple ejection openings respectively corresponding to the multiple nozzles being formed, and multiple protective parts protruding from the liquid ejection surface, the multiple protective parts being arranged along the nozzle arrangement direction, beside the multiple ejection openings, respectively. Further, the multiple protective parts are formed by press working applied to the laminated member from a passage body.

According to aspects of the disclosures, there is provided a method of manufacturing liquid ejecting device having a fluid passage structure formed with multiple nozzles arranged in a particular nozzle arrangement direction and multiple passages respectively communicating with the multiple nozzles. The method includes a laminating process of laminating and boding a first plate which is made of synthetic resin and included in the fluid passage structure, the first plate being formed with the multiple nozzles, and a second plate which is made of metallic material and included in the fluid passage structure, the second plate being formed with the multiple individual passage parts communicating with the multiple nozzles in the fluid passage, and a protective part forming process of forming multiple protective parts on the laminated body of the first plate and the second plate such that the multiple protective parts protrude from the liquid ejection surface on which ejection openings of the multiple nozzles are arranged and are aligned along the nozzle arrangement direction, after the laminating process. The multiple protective parts are formed by press working applied to the laminated body from a second plate side.

BRIEF DESCRIPTION OF THE ACCOMPANYING DRAWINGS

FIG. 1 schematically shows a plan view of an inkjet printer according to aspects of an illustrative embodiment of the disclosures.

DETAILED DESCRIPTION OF THE EMBODIMENTS

Referring to the accompanying drawings, an illustrative embodiment and its modifications will be described. In the embodiments, an invention of a liquid ejecting device will be applied to an inkjet head.

Figure 1:
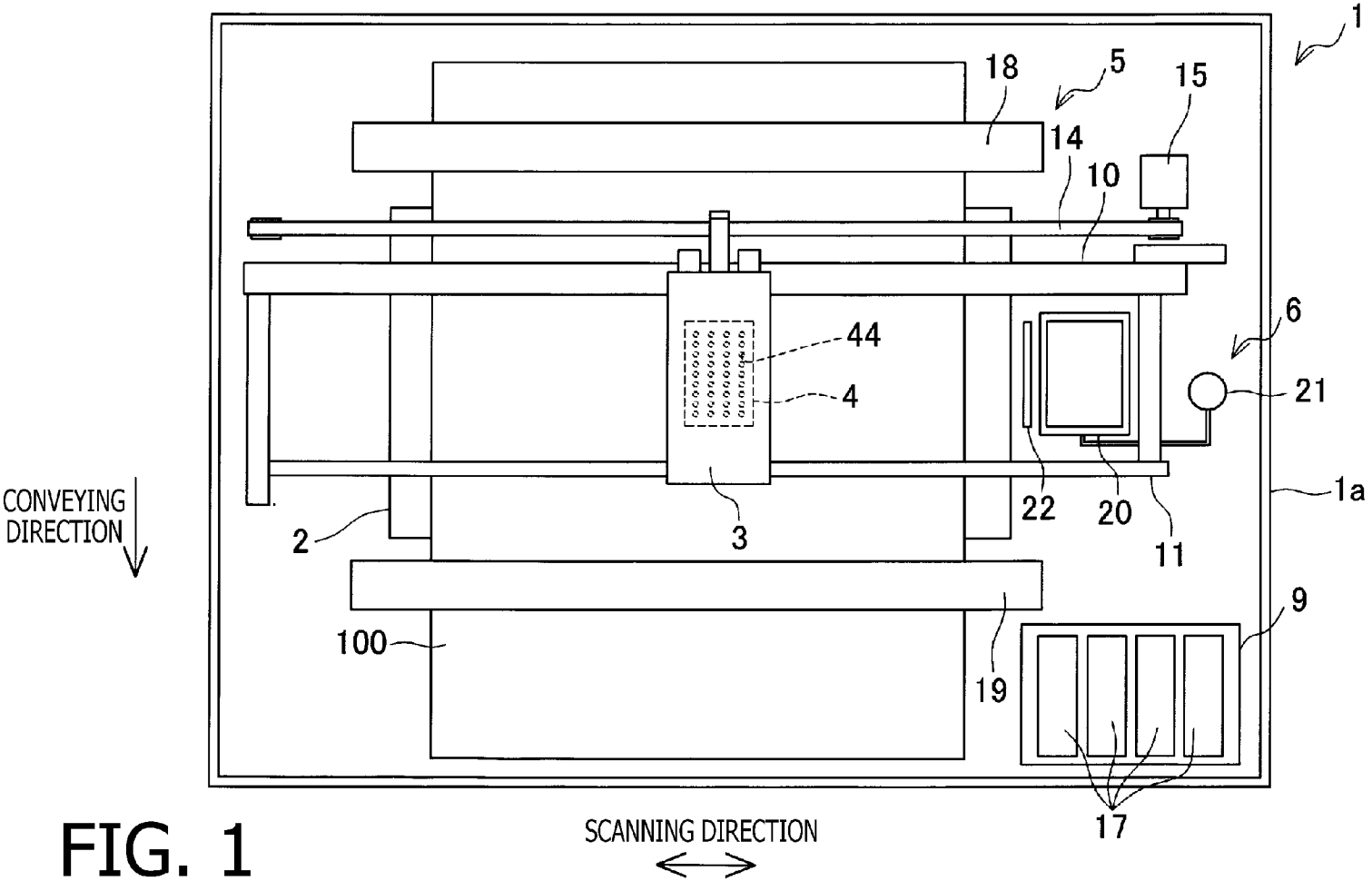

FIG. 1 schematically shows a plan view of an inkjet printer 1 according to an illustrative embodiment of the disclosures. In the following description, directions with respect to the inkjet printer 1 are defined such that a direction closer with respect to plane of FIG. 1 is an upper direction of the inkjet printer 1, while a direction farther with respect to the plane of FIG. 1 is a lower direction of the inkjet printer 1, the description will be made using the "upper" and "lower" directions with respect to the inkjet printer 1.

As shown in FIG. 1, the inkjet printer 1 has a platen 2, a carriage 3, an inkjet head 4, a conveying mechanism 5, and a maintenance mechanism 6.

A printing sheet 100 on which an image will be printed is to be placed on an upper surface of the platen 2. The carriage 3 is configured to reciprocally move along a pair of guide rails 10 and 11, in a scanning direction, within an range in which the carriage 3 faces the platen 2. The carriage 3 is connected with an endless belt 14. When a carriage drive motor 15 moves the endless belt 14, the carriage 3 moves in the scanning direction. Such a configuration is well-known, and will not be described in detail anymore.

The inkjet head 4 is attached to the carriage 3 and is movable, together with the carriage 3, in the scanning direction. On a lower surface, which is a farther side with respect to the plane of FIG. 1, of the inkjet head 4, multiple nozzles 44 are formed. Further, as shown in FIG. 1, a holder 9 is provided to a main body 1*a* of the inkjet printer 1. The holder 4 is configured to hold four ink cartridges 17 respectively storing ink of four colors (e.g., black, yellow, cyan and magenta). The four colors of ink respectively stored in the four ink cartridges 17 is supplied to the inkjet head 4 through tubes. Since such a structure is well-known, detailed description if illustration will not be provided for brevity. The inkjet head 3, together with the carriage 3, moves in the scanning direction, and ejects ink drops of four colors onto the printing sheet placed on the platen 2.

The conveying mechanism 5 has two conveying rollers 18 and 19, which are arranged on opposite sides, in a conveying direction, with respect to the platen 2 such that the conveying rollers 18 and 19 sandwich the platen 2 therebetween in the conveying direction. The conveying mechanism 5 conveys the printing sheet 100 placed on the platen 2 with the two conveying rollers 18 and 19 in the conveying direction.

As movement of the inkjet head 4 in the scanning direction and ejection of the ink drops from the multiple nozzles 44, and conveying of the printing sheet 100 in the conveying direction by a particular amount with use of the conveying rollers 18 and 19 are executed alternately, an image and/or characters are printed on the printing sheet 100.

The maintenance mechanism 6 is arranged on a right side with respect to the platen within a movable range of the carriage 3 in the scanning direction. The maintenance mechanism 6 has a cap 20, a suction pump 21 connected to the cap 20, and a wiper 22.

The cap 20 is configured to move in the up-down direction (i.e., in a direction orthogonal to the plane of FIG. 1). When the cap 20 moves upward when the carriage 3 is located to face the cap 20, the cap closely contacts the lower surface of the inkjet head 4 to cover the multiple nozzles 44. In this state, a suction purge is executed, that is, by reducing the pressure inside the cap 20 with use of the suction pump 21, ink is forcibly discharged from the multiple nozzles 44. As the suction purge is executed, dust particles, bubbles and/or viscosity-increased ink due to drying are forcibly discharged from the multiple nozzles 44, discharge failure of the nozzles 44 due to the dust particles, bubbles and the like can be prevented.

The wiper 22 is a thin plate member made of elastic material such as rubber, and arranged next to the cap 20 in the scanning direction Immediately after the suction purge is executed, ink is adhered on the lower surface of the inkjet head. According to the illustrative embodiment, after the suction purge is executed, the carriage 3 is moved in the scanning direction with the cap 20 spaced from the lower surface of the inkjet head 4. During this movement of the inkjet head 4, the wiper 22 keeps contacting the lower surface of the inkjet head 4 and moves relative to the loser surface of the inkjet head 4 so that the ink adhered onto the lower surface of the inkjet head 4 is wiped off.

Figure 2:
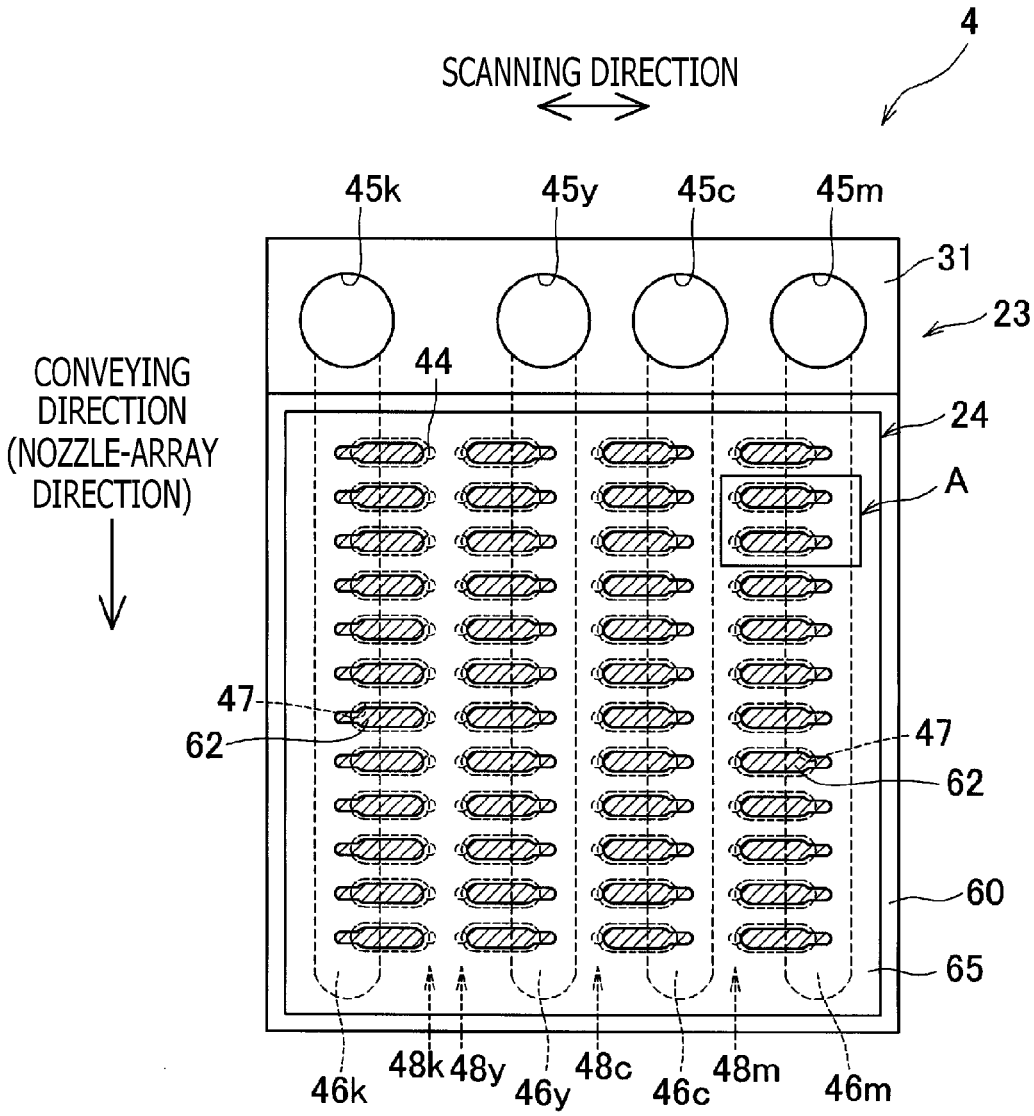
FIG. 2 is a top view of the inkjet printer according to aspects of the illustrative embodiment of the disclosures.
Figure 3:
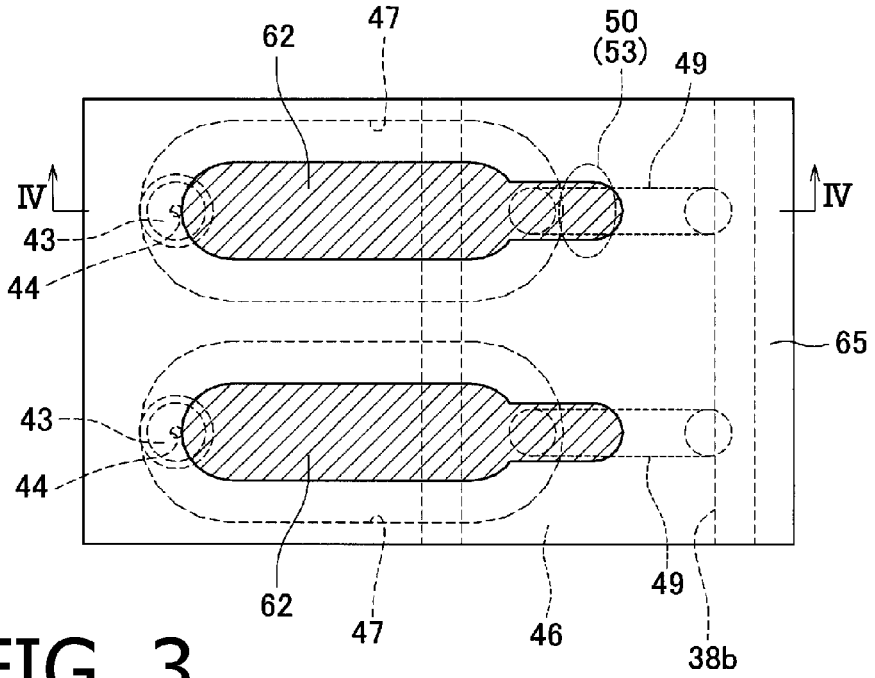
FIG. 3 is an enlarged view of a part of FIG. 2.
Figure 4:
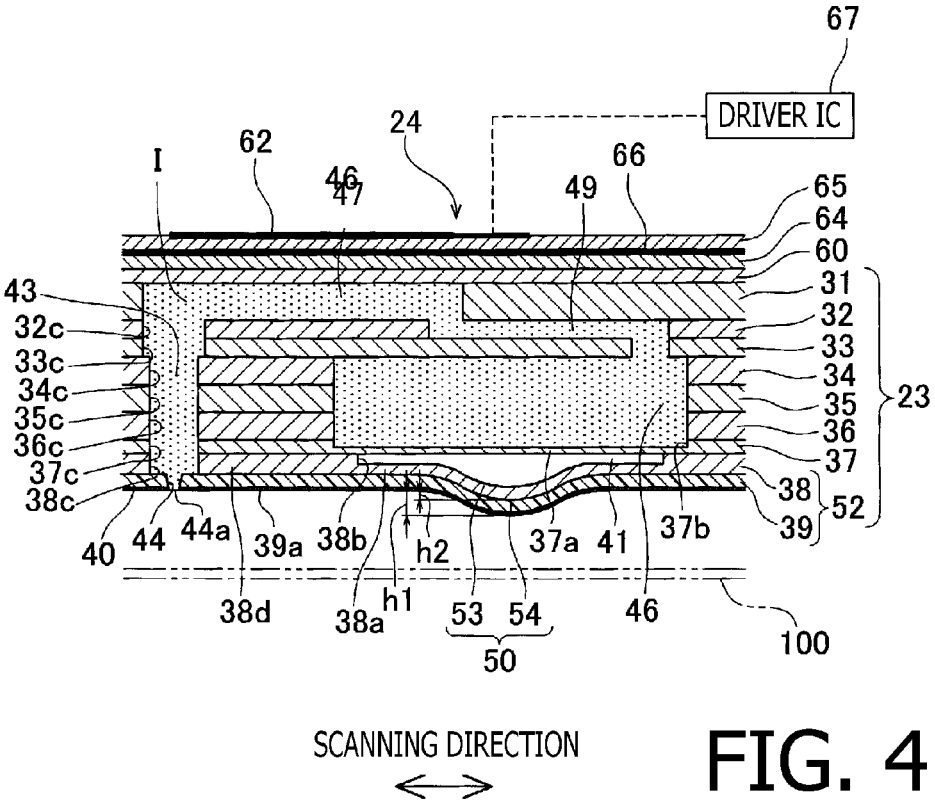
FIG. 4 is a cross-sectional view of the inkjet head taken along ling IV-IV in FIG. 3, according to aspects of the illustrative embodiment of the disclosures.

As shown in FIGS. 2-4, the inkjet head 4 has a passage unit 23, and a piezoelectric actuator 24. It is noted that FIG. 4 shows a state where the ink I is filled in an ink flow passage formed inside the passage unit 23.

<Passage Unit>

As shown in FIG. 4, the passage unit 23 has a laminated structure of having multiple laminated plates 31-39. The multiple plates 31-39 are bonded with adhesive agent in the laminated state.

The lowermost plate 39 is a nozzle plate on which the multiple nozzles 44 are formed. Each of the nozzles 44 is a through-opening piercing through the plate 39, the through-opening has a tapered cylindrical shape of which a lower side (i.e., an ink ejection side) has a smaller diameter. In the following description, the lower surface of the nozzle plate 39 on which the ejection openings 44*a* are formed will occasionally be referred to as an ink ejection surface 39*a* (see FIG. 4).

Figure 5:
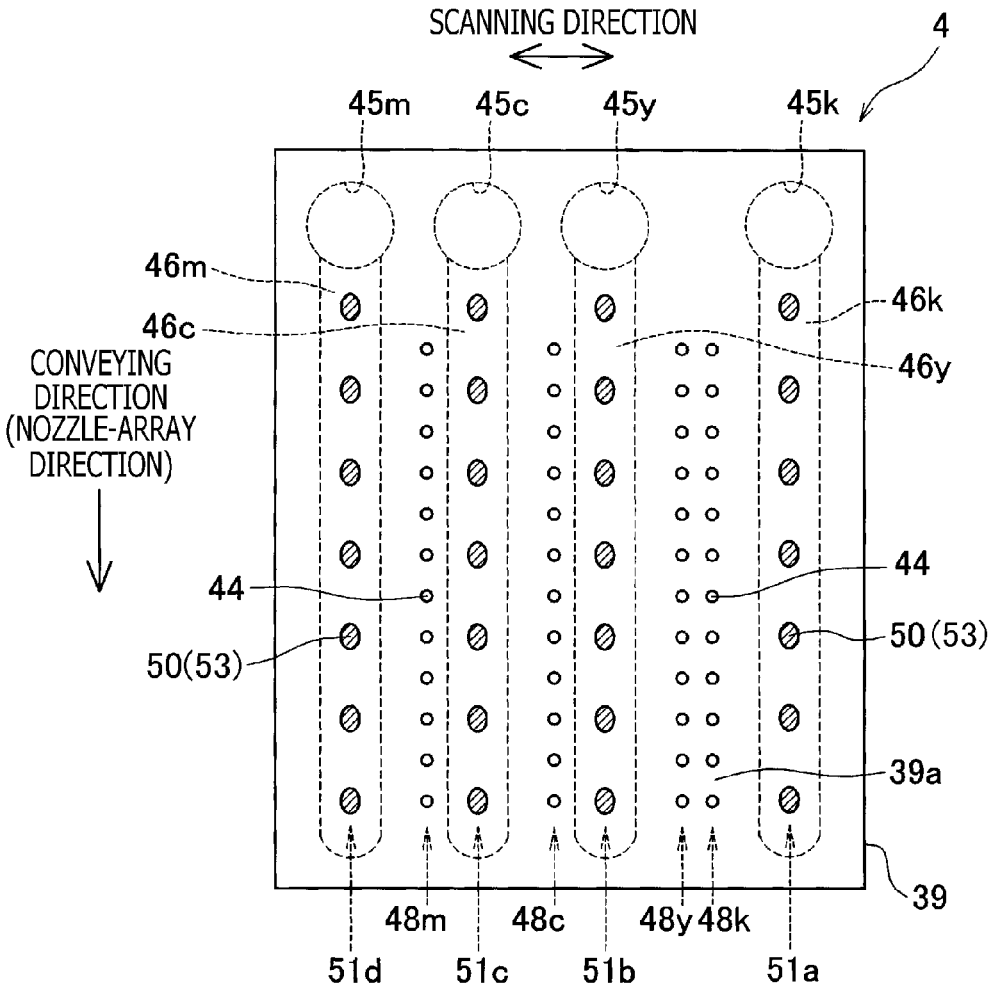
FIG. 5 is a bottom view of an inkjet head according to aspects of the illustrative embodiment of the disclosures.

As shown in FIGS. 2 and 5, the multiple nozzles 44 are arranged in four lines, each line extending in the conveying direction, and the four lines are arranged in the scanning direction. In the following description, each line of the nozzles 44 will be referred to as a nozzle array. As shown in FIG. 5, the four lines of the nozzles 44 constitute four nozzle arrays 48*k*, 48*y*, 48*c* and 48*m* which are configured to eject ink drops of black, yellow, cyan and magenta, respectively. Each of or all of the nozzle arrays 48*k*, 48*y*, 48*c* and 48*m* will occasionally be referred to simply by a term "nozzle array 48" collectively.

The ink ejection surface 39*a* of the nozzle plate 39 is covered with a liquid-repellent coat 40 made of fluorine resin such as PTFE (polytetrafluoroethylene). As the liquid-repellent coat 40 covers the ink ejection surface 39*a* at a surrounding area of each of the ejection openings 44*a*, the ink ejected by the nozzles 44 are prevented from residing on portions surrounding the ink ejection openings 44. It is noted that, although the liquid-repellent coat 50 is formed on an entire area of the lower surface of the nozzle plate 39, such a configuration can be modified so that only surrounding areas of the ejection openings 44*a* of the ink ejection surface 39*a* are covered with the liquid-repellent coat 40.

Among the multiple plates 31-39 constituting the passage unit 23, the multiple plate 31-39 other than the nozzle plate 39 are made of metallic material such as stainless steel. According to the illustrative embodiment, each of the multiple plates 31-38 is formed such that a sheet-like rolled material formed by rolling to have a particular thickness is carved up into pieces having particular sizes. The multiple plates 31-38 are bonded with adhesive agent in the laminated state. In the laminated multiple plates 31-38, ink passages including manifolds 46 and pressure chambers 47 are formed. Hereinafter, the multiple metallic plates 31-38 and ink passages formed therein will be described in detail.

As shown in FIG. 2, on the uppermost plate 31 which serves as an top surface of the passage unit 23, four ink supply holes 45*k*, 45*y*, 45*c* and 45*m* are formed along the scanning direction. In the following description, each of or all of the four ink supply holes 45*k*, 45*y*, 45*c* and 45*m* will occasionally be referred to collectively as ink supply holes 45. To the four ink supply holes 45 (45*k*, 45*y*, 45*c* and 45*m*), the ink of four colors (i.e., black, yellow, cyan and magenta) is supplied from the ink cartridges 17 (see FIG. 1) held in the holder 9, respectively.

Further, on the fourth to seventh plates 34-47 from the top, four manifolds 46*k*, 46*y*, 46*c* and 46*m* are formed. It is noted that each of or all of the four manifolds 46*k*, 46*y*, 46*c* and 46*m* will occasionally be referred to collectively as manifolds 46. According to the illustrative embodiment, each manifold 46 is formed through the four laminated plates 34-37. The four ink supply holes 45 are connected to the four manifolds 46, respectively, through communication holes (not shown) formed on the plates 32 and 33.

On the lowermost plate 37 of the four plates 34-37 forming the manifolds 46, four concave parts 37*b* extending along the four manifolds 46 are formed by half etching, at portions serving as a bottom wall parts 37*a* that partition the four manifolds 46 as shown in FIG. 4. Because of this configuration, the thickness of the plate 37 around the bottom wall parts 37*a* are smaller than the other parts of the plate 37.

Further, on an upper surface of the plate 38 which is located immediately below the plate 37, concave parts 38*b* are formed by half etching at portions facing the bottom wall parts 37*a*. The portions of the plate 38 facing the bottom wall parts 37*a* are formed to be thin-walled parts 38*a* having smaller thickness than the other parts of the plate 38. Furthermore, spaces 41 are formed between the bottom wall parts 37*a* of the manifolds 46 formed on the plate 37 and the thin-walled parts 38*a* formed below the bottom wall parts 37*a*, respectively. With this configuration, in accordance with pressure change inside the manifolds 46, the bottom wall parts 37*a* easily deform so that the pressure changes inside the manifolds 46 are reduced by deformation of the bottom wall parts 37*a*.

On the uppermost plate 31, multiple pressure chambers 44 respectively corresponding to the multiple nozzles 44 are formed. The multiple pressure chambers 47 are arranged to have four lines corresponding to the four manifolds 46. The multiple pressure chambers 47 are covered with a vibration plate 60 of the piezoelectric actuator 24. As shown in FIGS. 3 and 4, each pressure chamber 47 has an elongated shape which is longer in the scanning direction. Further, a left end part of each pressure chamber 47 overlaps the corresponding nozzle 44 and a right end part of each pressure chamber 48 overlaps the corresponding manifold 46, when viewed from the above.

According to the illustrative embodiment, as shown in FIG. 2, a line of the pressure chambers 47 corresponding to the black ink is arranged on the right side with respect to the corresponding manifolds 46, while each of the lines of the pressure chambers 47 corresponding to the ink of the other three colors is arranged on the left side with respect to the corresponding manifolds 46.

As shown in FIGS. 3 and 4, on the plate 32 which is the second plate from the top of the passage unit 23, multiple throttle passages 49 connecting the manifolds 46 and the multiple pressure chambers 47 are formed. Further, on the seven plates 32-38 between the uppermost plate 31 and the lowermost plate 39 of the passage unit 23, individual passage holes 32*c*-38*c* constituting communication passages 43 connecting the pressure chambers 37 and the nozzles 44 are formed.

It is noted that the individual passage hole 38*c* which is arranged immediately above the nozzle plate 39 has formed to be a thick part 38*d* which is thicker than the thin part 38*a* which corresponds to the manifold 46.

The plates 31-39 described above are laminated and bonded to constitute the passage unit 23. Inside the passage unit 23, from one manifold 46, multiple individual passages are diverged to reach the multiple nozzles 44 via the throttle passage 49, the pressure chamber 47 and the communication passages 43.

In a conventional inkjet head, there could be a situation where the printing sheet being conveyed in the conveying direction contacts the ink ejection surface of the inkjet head when the printing sheet is jammed or conveyed as it is in a bent state. In such a case, an end part of the ejection opening or a surrounding area of the ejection opening may be scratched by the printing sheet, which may cause an ejection failure in an ink ejection direction or the like. In particular, when the ink ejection surface is covered with the liquid-repellent coat, scratching of the liquid-repellent coat around the ink ejection opening may lower liquid-repellency, which may result in residual ink around the ink ejection opening and ejection failure of the ink drops.

According to the illustrative embodiment, multiple convex parts 50 are formed on the ink ejection surface 39*a*, as shown in FIGS. 3-5, to prevent the printing sheet 100 from contacting the surrounding areas of the ejection openings 44*a*.

As shown in FIGS. 3-5, multiple lines of convex parts 50 are arranged on the ink ejection surface 39*a* of the nozzle plate 39. According to the illustrative embodiment, there are five lines (51*a*-51*e*) of convex parts 50, and in each of the lines 51*a*-51*e*, multiple convex parts 50 are arranged in the conveying direction. In the following description, each of the lines 51*a*-51*e* of the convex parts 50 will occasionally be referred by a representative numeral 51.

As described above, on the nozzle plate 39, the four nozzle arrays 48 (48*k*, 48*y*, 48*c* and 48*m*) respectively configured to eject black, yellow, cyan and magenta ink are arranged in the scanning direction. Then, as shown in FIG. 5, the five lines 51 (51*a*-51*e*) of convex parts are arranged next to the four nozzle arrays 48 in the scanning direction. It is noted that, in FIG. 5, five lines 51, each of which extends in the conveying direction, are arranged in the scanning direction. Therefore, it could be said that the convex parts 50 are arranged in both the conveying direction and the scanning direction. In such a view, however, the number of arrangement of the convex parts 50 in the conveying direction is larger than that in the scanning direction.

On both sides, in the scanning direction, of the nozzle array 48*k*, two lines 51*a* and 51*b* of the convex parts 50 are arranged so that the two lines 51*a* and 51*b* sandwiches the nozzle array 48*k*. The three lines 51*b*, 51*c* and 51*d* of the convex parts 50 are arranged between each two of the four nozzle arrays 48 (48*k*, 48*y*, 48*c* and 48*m*). With this arrangement, each of the four nozzle arrays 48 (48*k*, 48*y*, 48*c* and 48*m*) is sandwiched, in the scanning direction, by two lines 51 of the convex parts 50.

As described above, the multiple convex parts 50 are arranged along the nozzle arrangement direction (i.e., the conveying direction), and next, in the scanning direction, to the multiple nozzles 44. Further, each nozzle array 48 is sandwiched between two lines 51 of the convex parts 50 arranged at closer positions in the scanning direction. With this configuration, regardless whether the carriage 3 moves leftward or rightward, the printing sheet 100 will not contact the surrounding areas of the nozzles 44 so easily. Thus, it is ensured that the surrounding area of the ejection opening 44*a* of each nozzle 44 is protected by the convex parts 50 arranged closer to the ejection opening 44*a*, and the liquid-repellent coat 40 is prevented from being scratched or damaged.

The protective parts 50 are formed such that a nozzle plate 39 made of synthetic resin and the metallic plate 38, which is harder than the nozzle plate 38, are laminated to form an integrated laminated body 52, and the laminated body 52 is deformed to have downwardly protruded parts. In other words, each protective part 50 has a convex part 53 which is formed to protruded downward toward the nozzle plate 39 side, and a covering part 54 which is a part of the nozzle plate 39 covering the protruded part 53 from below.

As shown in FIGS. 3 and 5, each protective part 50 (i.e., the convex part 53) has an oval shape in plan view (i.e., when viewed from the above), having a longer diameter in the conveying direction (i.e., the nozzle arrangement direction). As is described later, the multiple protective parts 50 are formed by applying press working to the laminated body 52 from the plate 38 side. It is also noted that the portions of the plate 38 to which the press working is applied to thin parts 38*a*, which correspond to the manifolds 46, respectively.

As described above, each protective part 50 has a metallic convex part 53 and a plastic (i.e., made of synthetic resin) covering part 54 which covers the convex part 53. Since the metallic convex part 53 is included in the protective part 50, the strength of the protective part 50 is enhanced, which makes the convex part 53 excellent in durability. That is, even if the printing sheet 100 hits the protective part 50, the protective part 50 will not be lost as whittled or hipped by the printing sheet 100.

As shown in FIG. 4, the protective part 50 is protruded with respect to the ink ejection surface 39*a* by an amount h1. In order to prevent the printing sheet 100 from contacting the surrounding areas of the nozzles 44 on the ink ejection surface 39*a*, the height h1 of the protective part 50 (i.e., the protruding amount with respect to the ink ejection surface 39*a*) is relatively high. According to the illustrative embodiment, the height h1 of the protective part 50 is approximately 100 μm.

Further, the metallic convex part 53 included in each protective part 50 is also protruded, with respect to the ink ejection surface 39*a*, by an amount h2 (which is smaller than h1). With this configuration, even if the printing sheet 100 repeatedly hits the protective part 50, and the covering part 54 is whittled and the convex part 53 of the plate 38 is exposed, since the convex part 53 itself is protruded with respect to the ink ejection surface 39*a*, a protective function to protect the surrounding areas of the ejection openings 44*a* is maintained.

An apex of each convex part 53 is formed to have a rounded shape, and accordingly, each protective part 50, which is formed such that the convex part 53 is covered by the covering part 54, also has the rounded shape as a whole. Accordingly, even if the printing sheet 100 hits the protective part 50, the printing sheet 100 may not be damaged. Further, because of the above shape, when the ink adhered onto the ink ejection surface 39*a* is wiped by the wiper 22, the wiper 22 may not be caught by the protective parts 50. It is noted that, when the covering part 54 of the nozzle plate 39 is whittled and the convex part 53 is exposed from the nozzle plate 39, the wiper 22 may be scratched or the printing sheet 100 may be caught depending on the shape of the convex part 53. Therefore, it is preferable that the curvature of the apex of the convex part 53 is as gentle as possible, and for example, the radius of curvature thereof is approximately 10 μm.

<Piezoelectric Actuator>

As shown in FIGS. 2 and 4, the piezoelectric actuator 24 has the vibration plate 60, piezoelectric layers 64 and 65, multiple individual electrodes 62, and a common electrode 66. The vibration plate 60 is boded on the upper surface of the passage unit 23 with covering the multiple pressure chambers 47. The two piezoelectric layers 64 and 65 are laminated on the upper surface of the vibration plate 60. The multiple individual electrodes 62 are arranged on the upper surface of the upper piezoelectric layer 65 so as to face the multiple pressure chambers 47, respectively. The common electrode 66 is arranged between the two piezoelectric layers 64 and 65 so as to span across the multiple pressure chambers 47.

The multiple individual electrodes 62 are respectively connected to driver ICs (integrated circuits) 67, which are configured to control the piezoelectric actuator 24. The common electrode 66 is always kept to have a grounded electric potential. Further, portions of the upper piezoelectric layer 65 sandwiched between the individual electrodes 62 and the common electrode 66 are polarized in its thickness direction, respectively.

An operation of the piezoelectric actuator 24 when the ink drops are ejected from the nozzles 44 will be described. When a drive signal is applied from the driver IC 67 to a certain individual electrode 62, a potential difference is generated between the individual electrode 66 and the common electrode which is maintained to have the ground potential. Then, in a portion of the piezoelectric layer 65 at a portion sandwiched by the individual electrode 62 and the common electrode 66, an electrical field is generated in its thickness direction.

Since the polarization direction of the piezoelectric layer 65 and the direction of the electric field coincide with each other, the piezoelectric layer 65 extend in the thickness direction, which is the polarization direction, and shrinks in a surface direction. In association with this deformation (i.e., extension and shrink) of the piezoelectric layer 65, a portion of the vibration plate 60 facing the pressure chamber 47 warps to protrude toward the pressure chamber 47. At this stage, a capacity of the pressure chamber 47 is reduced and a pressure is applied to the ink inside the pressure chamber 47, thereby an ink drop is ejected through the nozzle 44 communicating with the pressure chamber 47.

Next, a method of manufacturing the inkjet head 4 described above will be described centering on a manufacturing process of the passage unit 23.

<Passage Unit Manufacturing Process>

Firstly, on the metallic plates 31-38 constituting the passage unit 23, openings and holes constituting parts of the ink flow passages such as the pressure chambers 47, the manifolds 46 and individual passage holes 32*c*-38*c* are formed by etching.

At the same time, the concave parts 37*b* are formed on the plate 37 by half etching. Further, by forming the concave parts 38*b* on the plate 38 by half etching, the thin parts 38*a* are formed.

<Liquid-Repellent Coat Forming Process>

Figure 6A:
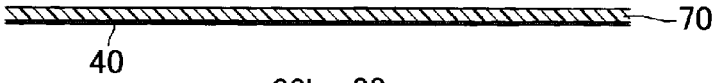
FIGS. 6A-6G illustrate a manufacturing process of the inkjet head according to aspects of the illustrative embodiment of the disclosures.

Next, as shown in FIG. 6A, the liquid-repellent coat 40 is formed on one surface (i.e., the ink ejection surface 39*a*) of synthetic-resin plate 70, which will serve as the nozzle plate 39, the liquid-repellent coat 40 is formed. The liquid-repellent coat 40 may be formed by adhering a fluorine resin film on the synthetic-resin plate 70, or by applying fluorine resin liquid on the synthetic-resin plate 70.

<Laminating Process>

Figure 6B:
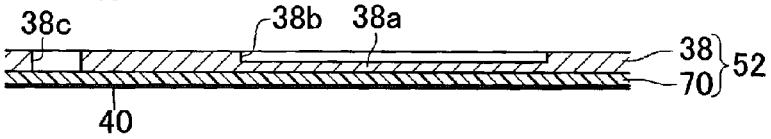

Next, as shown in FIG. 6B, the synthetic-resin plate 70, which will serve as the nozzle plate 39, and one metallic plate 38 on which the individual passage holes 38*c* are formed in the previous process are laminated and bonded by adhesive agent.

<Protective Film Adhering Process>

Figure 6C:
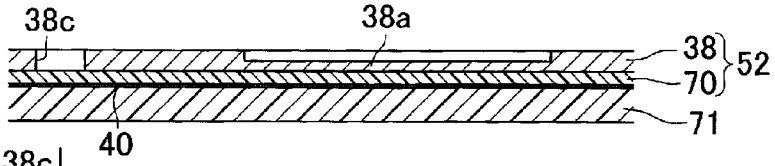

Next, as shown in FIG. 6C, a protective film 71 made of synthetic resin film is adhered on the surface, which will serve as the ink ejection surface 39*a*, of the synthetic-resin plate 70. The protective film 71 is, for example, adhered on the synthetic-resin plate 70 using a UV (ultraviolet) releasable adhesive agent.

<Nozzle Forming Process>

Figure 6D:
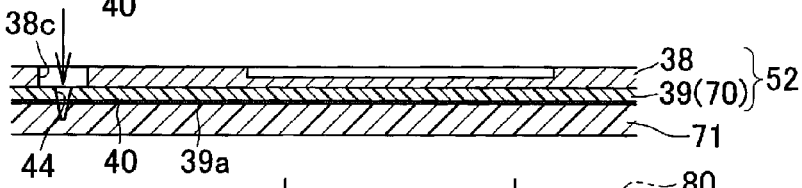

Next, as shown in FIG. 6D, multiple nozzles 44 are formed on the synthetic-resin plate 70 of the laminated body by laser machining. In the laser machining process, for example, a laser beam is emitted to the laminated body 52 such that the laser beam is incident on the synthetic-resin plate 70 at portions corresponding to the multiple individual passage holes 38*c* formed on the plate 38. The laser beam is incident on the synthetic-resin plate 70 through the individual passage hole 38*c*, and pierces through the synthetic-resin plate 70 as shown in FIG. 6D. As a result, at the portions of the synthetic-resin plate 70 corresponding to the individual passage holes 38*c*, the multiple nozzles 44 are formed, respectively. It is noted that the lower surface of the synthetic-resin plate 70 which will serve as the ink ejection surface 39*a* is covered by the protective film 71, which prevents grimes generated when the multiple nozzles 44 are formed from adhering on the liquid-repellent coat 40 on the ink ejection surface 39*a*.

<Protective Part Forming Process>

Figure 6E:
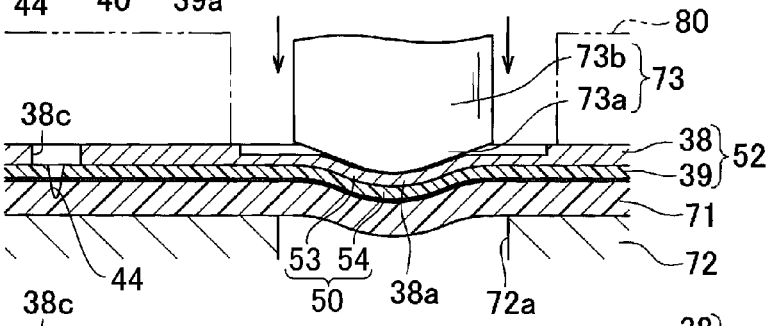

Next, as shown in FIG. 6E, the multiple protective parts 50 are formed by applying press working to the laminated body 52. For example, the laminated body 52 covered by the protective film 71 is placed on the die 72 having the multiple cut holes 72*a* such that the thin parts 38*a* of the metallic plate 38 are located on the multiple cut holes 72*a* of the die 72, respectively.

Next, a tip of a punch 73 is placed on the thin part 38*a* of the metallic plate 38, and pushing the tip of the punch 83 into the laminated body 52 from the plate 38 side, thereby the press machining being applied. With the above process, the multiple convex parts 53 are formed as plastic deformation is caused to the metallic plate 38 to form the convex part 53, and further the entire laminated body at that portion is deformed to protrude downward. A pushing amount of the punch 73 is set such that the apex of the convex part 53 is located at a lower level than the ink ejection surface 39*a* of the nozzle plate 39 (i.e., the synthetic-resin plate 70). It is noted that, since the ink ejection surface 39*a* of the nozzle plate 39 is covered by the protective film 71 and does not contact the die 72, the liquid-repellent coat 49 formed on the nozzle plate 39 is prevented from being damaged by the die 72.

As shown in FIG. 6E, the punch 73 has a substantially cylindrical shape formed with a tapered part 73*a* of which diameter is smaller toward the end side. When the punch 73 is press-contacted onto the laminated body 52, it is preferable that only the tapered part 73*a* is pushed in while a straight part, of which the diameter remains unchanged, is not pushed in. By press-contacting the punch 73 in such a way, shear deformation occurred to the metallic plate 38 can be made smaller and rupture of the metallic plate 38 can be prevented. Further, by inserting only the tapered part 73*a* of the punch 73, friction between the punch 73 and the metallic plate 38 becomes relatively small, and it is unnecessary to use processing oil for lubrication. Accordingly, after the press working, a washing process to wash out the processing oil adhered on the metallic plate 38 is unnecessary.

In a general press working, a stripper is provided to a surface of a work on which the punch is press-contacted in order to ensure that the punch is removed from the work after the press working and/or to prevent the warp of the work. When a foreign body is engaged between the work and the stripper, an indentation may be formed. According to the above-described illustrative embodiment, the punch 73 can easily be removed, after processing, from the metallic plate 38 since only the tapered part 73*a* is pushed in with respect to the metallic plate 38. Further, the warp of the metallic plate 38 caused by the press working is relatively small. Therefore, according to the illustrative embodiment, the processing can be executed without using the stripper 80. Therefore, in order to prevent the occurrence of the indentation on the metallic plate 38, it is preferable not to provide the stripper 80.

As described above, according to the illustrative embodiment, the multiple protective parts 50 protruded from the ink ejection surface 39*a* of laminated body 52 are formed by the press working from the metallic plate 38 side. Further, since the laminated body 52 subject to the press working includes metallic material, plastic deformation of the metallic material is occurred by the press working, thereby the shape of the protective parts 50 is maintained after the press working.

Further, when the press working is applied to the laminated body 52, only the punch 73 is pushed in the metallic plate 38, and it is unnecessary to apply heat to the synthetic-resin plate 70 (i.e., the nozzle plate 39), the nozzle plate 39 is not warped by the heat. That is, according to the illustrative embodiment, there is no need to be concerned with the warp of the nozzle plate 39, it is possible to deform the laminated body 52 relatively largely with the punch 73 so that the protective part 50, which is protruded from the ink ejection surface 39*a* relatively largely, can be formed in the vicinity of each nozzle 44.

It is noted that the metallic plate 38 is a metallic rolled member produced by the rolling process. Generally, the rolled member has an anisotropic property in its material structure since the rolled member is extended in its rolling direction, and the crystal grains are also extended in the rolling direction. Therefore, when the punch 73 is press-contacted on the metallic plate 38 and the protective part 50 is formed, deformation in the crystal grain boundary occurs easier in a direction orthogonal to the rolling direction than in the rolling direction. As a result, the deformation area is smaller in the direction orthogonal to the rolling direction. Thus, even though the cylindrical punch 73 is used, the protective part 50 formed on the laminated body 52 has an oval shape which is longer in the rolling direction as shown in FIGS. 3 and 5.

When the convex part 50 and the nozzle 44 are arranged in the rolling direction of the metallic plate 38, when the metallic member constituting the metallic plate 38 is expanded in the rolling direction when the convex part 50 is formed by the press working, there is a possibility that the individual passage hole 38*c* formed on the metallic plate 38 may be affected such that the shape of the individual passage hole 38*c* may change and/or the position of the individual passage holes 38*c* may be shifted. Therefore, it is preferable that the nozzle-array direction in which the nozzles 44 are arranged, which is also the conveying direction, coincides with the rolling direction of the metallic plate 38. With such a configuration, even though the metallic plate 38 deforms largely in the rolling direction at the time of press working, affects of the deformation on the individual passage holes 38*c* of the metallic plate 38 may by relatively small.

Regarding a relationship between the rolling direction and the protective parts 50, the following should also be noted. According to the illustrative embodiment, the multiple protective parts 50 are arranged in the two directions: the conveying direction (nozzle arrangement direction); and the scanning direction. Further, as shown in FIG. 5, the number of arranged nozzles 44 in the conveying direction is larger than the number of arranged nozzles 44 in the scanning direction. Since the protective parts 50 are parts of the laminated body 52 locally deformed to curve by the press working, the laminated body 52 is easier to extend/shrink along the conveying direction in which the number of the arranged convex parts 50 are larger than that in the scanning direction.

That is, the laminated body 52 is easier to warp in the conveying direction. On the other hand, when the metallic plate 38 is the rolled member, it is less easy to extend/shrink in the rolling direction since it has been extended in the rolling direction. Therefore, in view of suppressing the warp of the laminated body 52 due to formation of the protective parts 50, it is preferable that the conveying direction, in which the number of arranged nozzles 44 is larger than that in the scanning direction, is along the rolling direction of the metallic plate 38.

In the above description, an example in which the number of the protective parts 50 arranged in the conveying direction is larger than that in the scanning direction is described. However, when the number of the protective parts 50 arranged in the scanning direction is larger than that in the conveying direction, the scanning direction is aligned to the rolling direction of the metallic plate 38. Further, regarding the other plates 31-37 which also constitute the passage unit 23, by laminating the same such that the rolling direction of each of the metallic plates 31-37 coincides with the rolling direction of the metallic plate 38, the warp suppressing effect in the laminated body 52 can be increased.

According to the illustrative embodiment, before the protective part forming process is executed, the concave parts 38*b* are formed on the upper surface of the metallic plate 38. Then, to the think parts 38*a* formed by the concave parts 38*b*, the press working is applied to form the multiple protective parts 50. Since the press working is applied to the thin parts 38*a*, deformation caused by the press working does not expand, exceeding the boundary between the think parts 38*a* and the thick parts 38*d*, toward the thick parts 38*d* side where the individual passage holes 38*c* are formed so easily, an area within which the deformation affects is limited. Therefore, affection on the individual passage holes 38*c* by the deformation of the thin parts 38*a* at the time of the press working is suppressed.

<Protective Film Removal Process>

Figure 6F:
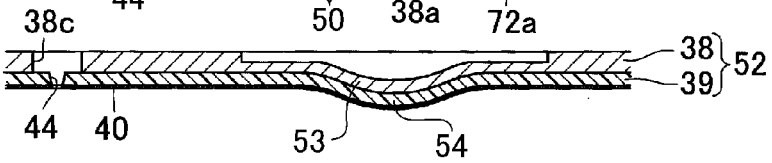

Next, the protective film 71 is removed from the synthetic-resin film 70 (i.e., the nozzle plate 39) as shown in FIG. 6F. When the protective film 71 is bonded to the nozzle plate 39 using the UV removal adhesive agent, by illuminating the protective film 71 with the UV light, the protective film 71 can be removed easily. Alternatively, depending on the type of the protective film 71, the protective film 71 can be removed by melting with use of an appropriate solvent.

<Bonding Process>

Next, the laminated body 52 on which the multiple protective parts 50 and the multiple nozzles 44 are formed, the other plates 31-37 constituting the passage unit 23, and the vibration plate 60 of the piezoelectric actuator 24 are bonded.

Figure 6G:
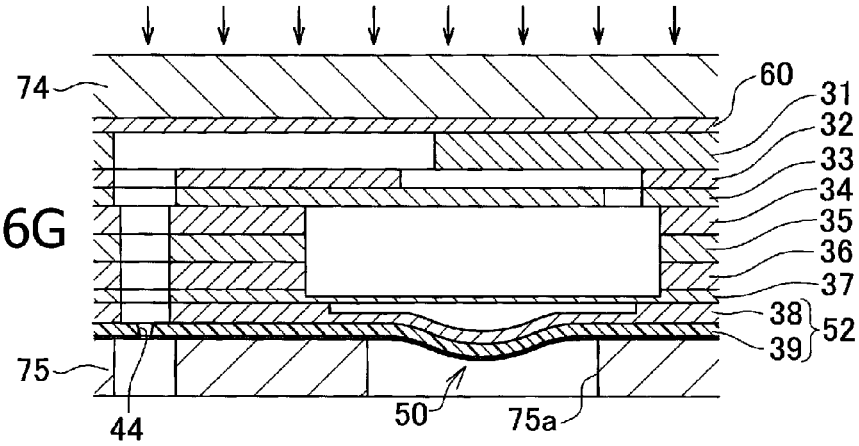

According to the illustrative embodiment, as shown in FIG. 6G, the laminated body 52, the metallic plates 31-37 and the vibration plate 60 are laminated after thermosetting adhesive is applied to bonding surfaces thereof, and they are bonded by applying heat and pressure from up and down sides with use of the heater plates 74 and 75. It is noted that concave or hole-like relieve parts 75*a* are formed on the bottom side heater plate 75 at positions corresponding to the convex parts 50 so that the convex parts 50 will not be crashed by the heater plate 75. After the above-described bonding process, piezoelectric layers 64 and 65, which are formed in another process, are bonded on the vibration plate 65, thereby the piezoelectric actuator 24 being configured.

In the above-described illustrative embodiment, the convex parts 53 protruding toward the nozzle plate 39 are formed on the metallic plate 39 which is laminated with the nozzle plate 39 made of the synthetic-resin. The convex parts 53 are covered by the covering parts 54 of the nozzle plate 39, thereby the protective parts 50 being constituted. Since the protective parts 50 includes the convex parts 53 made of metal, the protective parts 50 are excellent in strength and durability. Further, since the convex parts 53 are covered by the covering parts 54 made of the synthetic-resin, when the wiper 22 wipes the ink ejection surface 38*a*, the wiper will not be damaged by the ink ejection surface 38*a*.

It could occur that the printing sheet 100 repeatedly hits the covering part 54 of the nozzle plate 39, thereby the covering part 54 being gradually whittled and the convex part 54 may be exposed to outside. According to the illustrative embodiment, since the convex part 54, which is made of metal, protrudes from the ink ejection surface 39*a* of the nozzle plate 39, even thought the covering part 54, which covers the convex part 53, is whittled and the convex part 53 is exposed, protecting function to protect the areas surrounding the ejection openings 44*a* from the printing sheet 100 can be maintained. Further, since the convex part 53 is made of metallic material which is relatively hard, the convex part 53 may not be whittled easily as the covering part 54 is. It is noted that, when the convex part 53, which is made of metallic material, is exposed, the wiper 22 and the printing sheet 100 may directly hit the convex part 53. In order to prevent the wiper 22 and/or the printing sheet 100 from being damaged by the metallic member (i.e., the convex part 53), it is preferable that the apex of the convex part 53 has a gentle curvature, and for example, the radius of the curvature of the apex portion of the convex part 53 may be 10 μm or larger. With such a configuration, the wipe 22 may not be damaged so easily even though the wiper 22 hits the apex of the convex part 53. Further, the printing sheet 100 may not be caught by the convex part 53.

When the protective part 50 is formed on the nozzle plate 39 which is made of the synthetic resin, if a method requiring heating of the nozzle plate 39 such as heat pressing, the nozzle plate 39 may be warped by the heat and detachment of portion of the nozzle plate 39 may occur. According to the illustrative embodiment, the convex part 53 is formed by applying press working to the metallic plate 38 with the metallic plate 38 and the nozzle plate 39 being laminated to cause plastic deformation on the metallic plate 38. According to the method employed in the illustrative embodiment, the nozzle plate 39 (i.e., the synthetic-resin plate 70) will not be heated. Therefore, the nozzle plate 39 will not be warped by the heat when the convex parts 53 are formed, and the problem of detachment will not occur. It is noted that the higher the height (i.e., the protruding amount) of the convex part 53 is, the higher the protective effect of the convex part 53 to protect the surrounding area of the ejection opening 44*a*. According to the illustrative embodiment, since the press working is employed to form the convex parts 53, it is relatively easy to form the convex part 53 of which protruding amount is large on the metallic plate 38.

According to the illustrative embodiment, the inkjet head 4 moves, with respect to the printing sheet 100, in the scanning direction, which is orthogonal to the conveying direction (i.e., the nozzle-arrangement direction) together with the carriage 3. Because of such a configuration, when the ink resides on the areas surrounding the ink ejection openings 44*a*, the ink tends to move in the scanning direction due to the airflow around the ink ejection surface 39*a* caused by the movement of the inkjet head 4 and/or effect of acceleration/deceleration of the inkjet head 4 at end portions in the scanning range. Further, the ink moved in the scanning direction tends to be collected at the protective parts 50 arranged next to the nozzles 44.

If the ink moved in the scanning direction and concentrated around a particular protective part 50, effect of the ink when sprinkled due to vibration or the like is relatively large. Therefore, it is preferable that the ink collected around the protective parts 50 is distributed in a wider areas. In this regard, according to the illustrative embodiment, each of the multiple protective parts 50 arranged in the nozzle arrangement direction has an oval shape elongated in the nozzle arrangement direction. Therefore, the ink is collected on a side, in the scanning direction, of each protective part 50 in a manner distributed in the nozzle arrangement direction. Therefore, the effect of the ink when the collected ink is sprinkled can be suppressed to a relatively small extent.

In the illustrative embodiment described above, the inkjet head 4 is an example of the liquid ejecting device set forth in the claims. Further, the passage unit 23 is an example of a passage structure set forth in the claims. The metallic plate 38 on which the individual passage holes 38*c* are formed is an example of the passage member set forth in the claim which is provided with an individual passage part. Furthermore, the ink ejection surface 39*a* which is the lower surface of the nozzle plate 39 is an example of the liquid ejection surface set forth in the claims.

Still further, a plurality of plates 34-47 on which the manifolds 46 are formed is an example of the liquid chamber forming member 11, the synthetic-resin plate 70 which serves as the nozzle plate 39 is an example of a first plate set forth in the claims, and the metallic plate 38 in the illustrative embodiment is an example of a second plate set forth in the claims.

Next, various modifications based on the illustrative embodiment will be described. It is noted that the configurations/components similar to ones of the illustrative embodiment, the same reference numbers will be assigned and detailed description thereof will be omitted for brevity.

Figure 7A:
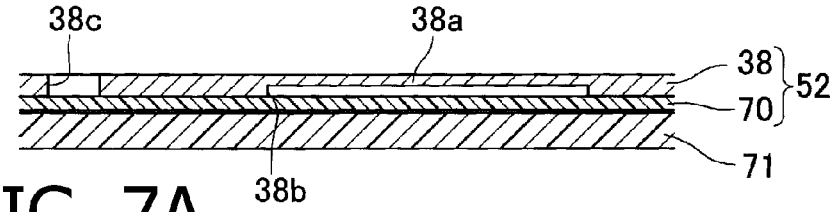
FIGS. 7A and 7B show a method of manufacturing convex parts according to aspects of the disclosure.
Figure 7B:
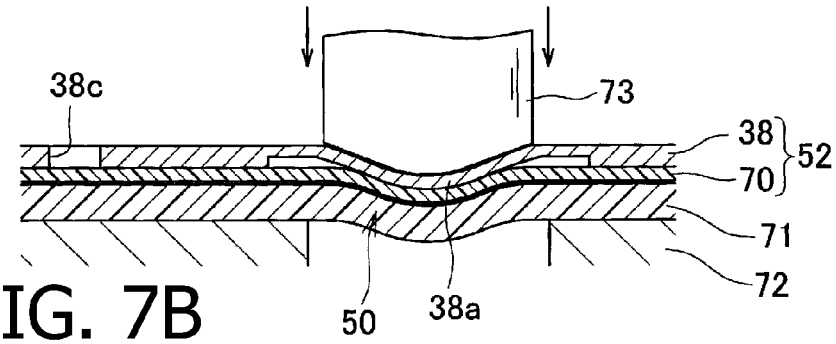

1) The shape of the thin parts 38*a* of the metallic plate 38 does not need to be limited to the shape of the illustrative embodiment. For example, for example, as shown in FIG. 7A, thin parts 38*a* may be formed by forming concave parts 38*b* on the nozzle plate side surface of the lower surface of the plate 38. In such a configuration, however, a clearance is formed between the thin part 38*a* of the plate 38 and the synthetic-resin plate 70, when the pressing process is applied to the thin part 38*a* from the plate 38 side, the protective part 50 having the intended shape may be difficult as shown in FIG. 7B. In this regard, it may be preferable that he concave part 38*b* is formed on the surface of the plate 38 opposite to the nozzle plate 39 as shown in FIG. 6.

2) Further, it is noted that formation of the thin parts 38*a* on the plate 38 before the convex parts 50 are formed should not be necessary. That is, it is also possible to form the multiple convex parts 50 by applying the pressing process to a planer plate 38 on which no concave parts 38*b* have not been formed.

3) According to the illustrative embodiment, as shown in FIGS. 6D and 6E, after the multiple nozzles 44 are formed to the synthetic-resin plate 70 with the laser machining, the press working is applied to the laminated body 52 to form the multiple protective parts 50 (i.e., the multiple convex parts 53 and the corresponding covering parts 54). This order may be reversed. That is, the multiple protective parts 50 may be formed on the laminated body 52 first, and then, the multiple nozzles 44 may be formed to the synthetic-resin plate 70.

4) It is noted that the method of forming the convex part 53 on the plate 38 does not need to be limited to the press working. For example, the multiple convex parts 53 may be formed on the lower surface of the plate 38 by etching, and then the synthetic-resin plate 70, which will serve as the nozzle plate 39, is bonded to the loser surface of the plate 38. Alternatively, the multiple convex parts 53 may be formed by machining (mechanical processing).

5) According to the illustrative embodiment, the synthetic-resin plate 70, which will serve as the nozzle plate 39, and a sheet of the metallic plate 38 are laminated to form the laminated body 52, and the press working is applied to the laminated body 52 to form the multiple protective parts 50. It is noted that the number of sheets of the plates laminated on the synthetic-resin plate 70 does not need to be limited to one. That is, the synthetic-resin plate 70 and more than one sheet of metallic plates may be laminated to for the laminated body 52, and the multiple protective parts 50 may be formed by applying the press working to the thus configured laminated body 52.

6) A combination of the materials of the nozzle plate 39 and the plate 38 (the passage unit) laminated with the nozzle plate 39 does not need to be limited to the synthetic-resin and the metal. A combination of other materials can be employed as far as the plate 38 is harder than the nozzle plate 39. For example, the material of the plate 38 may be an inorganic material such as glass, ceramics and the like. When such an inorganic material is employed, the convex parts may be formed by etching or machining process. Alternatively or optionally, the plate 38 (the passage unit) may be formed such that a main body formed of a basic material is provided with the convex portions formed of another material. For example, the basic material is a relatively soft resin, while the convex parts may be formed of relatively hard material such as metal of ceramics.

7) The shape of the convex part 53 does not need to be limited to that of the illustrative embodiment described above. By changing the shape of the tip of the punch 73 and/or the die 72, the convex part 53 may have various shapes. Further, depending on characteristic of material of the plate 38 (e.g., ductility and the like), the deformation direction of the convex part 53 may not slant in a particular direction of the nozzle plate 39. In such a case, when the punch 73 having the cylindrical shape is used, the convex part 53 may have a substantially circular shape when viewed from the above. Furthermore, depending on necessity, the convex part 53 may have a shape, viewed from the above, of a circle, a rectangle, a square and the like.

8) Positions of the convex parts 53 on the metallic plate 38 do not need to be limited to those of the illustrative embodiment. According to the illustrative embodiment shown in FIG. 5, two lines 51 of convex parts 53 are aligned on both sides of each nozzle array 48. This can be modified such that, for at least a part of the nozzle arrays 48, the line 51 of the convex parts 53 is arranged only on one side of the nozzle array 48. In an example shown in FIG. 8, for the nozzle array 48*k*, only one line 51*a* of the convex parts 53 is provided and no line of the convex parts 53 is provided on the opposite side of the nozzle array 48.

Figure 8:
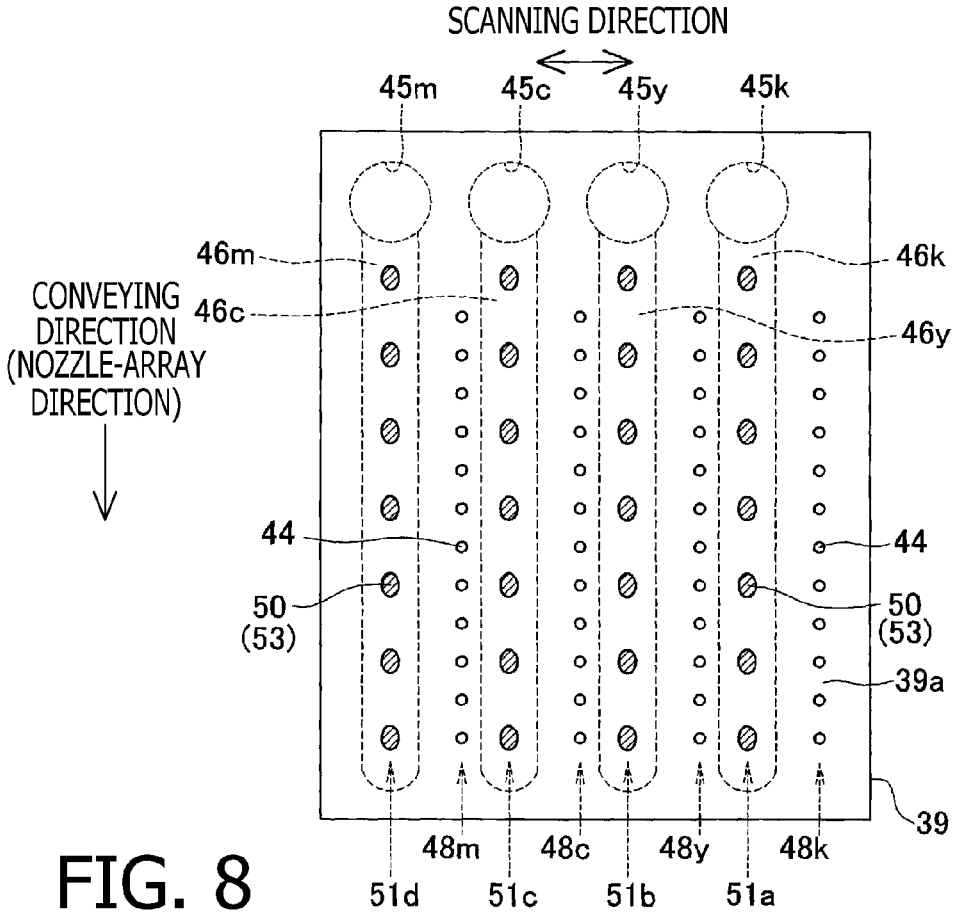
FIG. 8 is a bottom view of the inkjet head according to an eighth modification of the inkjet head.

According to another modification shown in FIG. 8, the convex parts 50 are arranged on an upstream side and/or a downstream side of the four lines of nozzle arrays 48 in the conveying direction. With this configuration, a protective effect around the nozzles 44 is enhanced.

Figure 9:
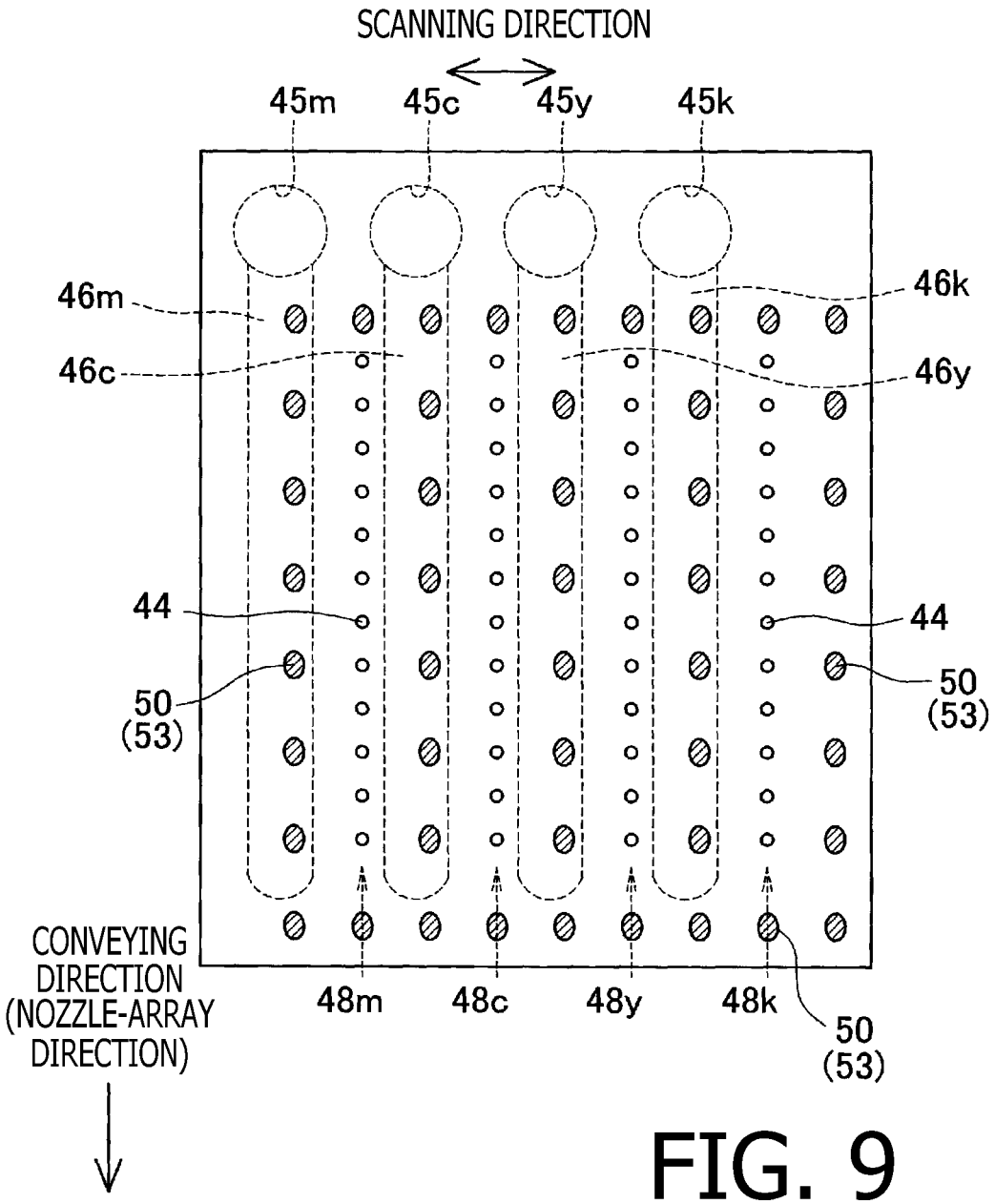
FIG. 9 is a bottom view of the inkjet head according to a ninth modification of the inkjet head.

9) In the illustrative embodiment, the concave parts 38*b* of the plate 38 are used not only for forming thin parts 38*a* but securing the clearance for allowing portions of the bottom wall 37*a* of the manifolds 46 located above the think parts 38*a*, respectively. Accordingly, as shown in FIG. 5, the protective parts 50 are formed at positions corresponding to the manifolds 46. However, the multiple protective parts 50 do not need to located at positions corresponding to the manifolds 46. That is, as shown in FIG. 9, the multiple protective parts 50 may be arranged freely, regardless of the locations of the manifolds 46. For example, the protective parts 50 may optionally be arranged on the laminated body 52 at positions on the upstream side, in the conveying direction, with respect to the four lines of the nozzle arrays 48. The protective parts 50 may optionally be arranged on the laminated body 52 at positions on the downstream side, in the conveying direction, with respect to the nozzle arrays 48. By arranging the protective parts 50 as above, protective effect around the nozzles is enhanced.

10) The inkjet head 4 according to the illustrative embodiment is a so-called serial type head, which is configured to eject the ink drops as it moves together with the carriage 3 with respect to the printing sheet 100. It is noted that the aspects of the disclosure does not need to be limited to the serial head. For example, the configuration according to the illustrative embodiment may be applied to a line type head which is fixedly provided inside a main body of the printer and is configured such that multiple nozzles are arranged in a width direction of the printing sheet 100.

Figure 10A:
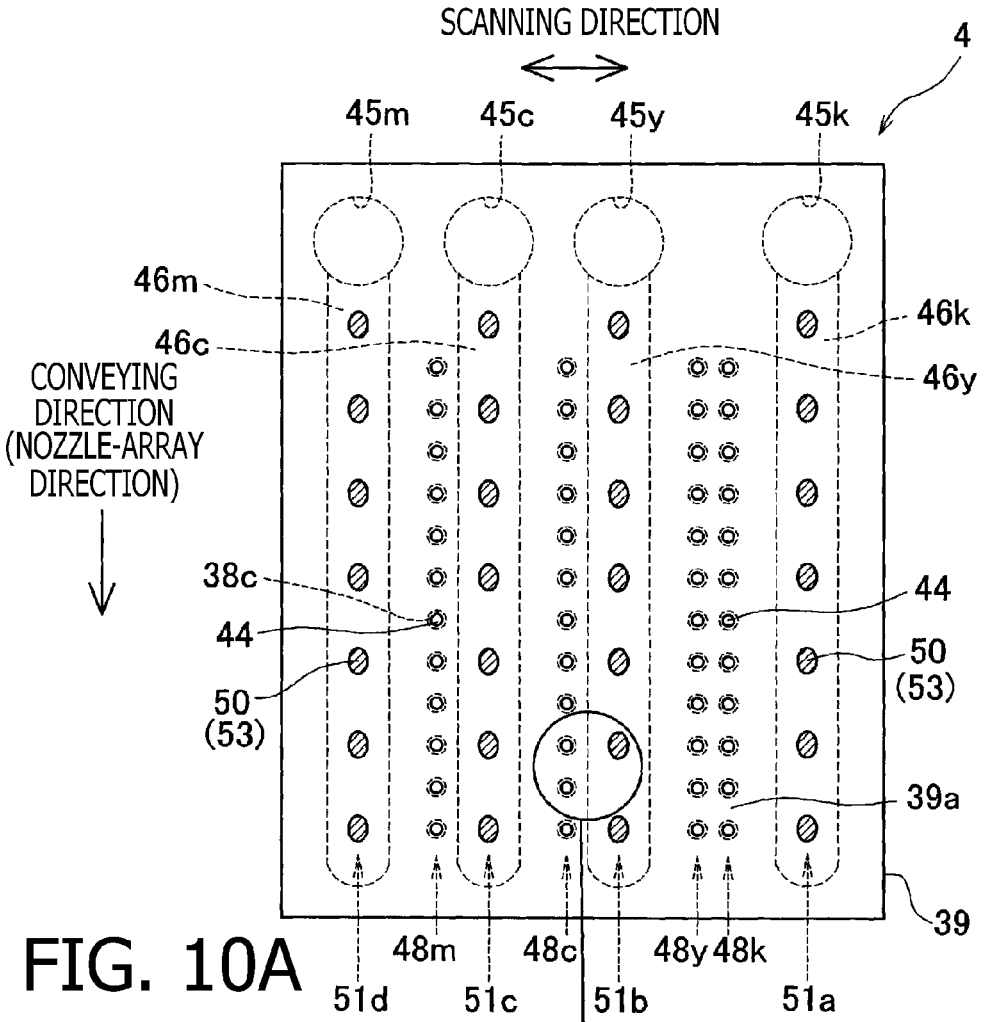
FIGS. 10A and 10B are a bottom view of the inkjet head and a partially enlarged view thereof according to an eleventh modification of the inkjet head.
Figure 10B:
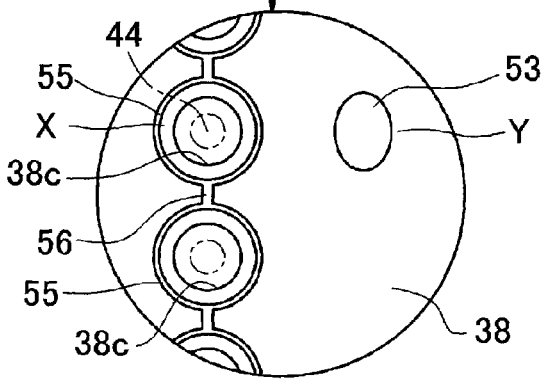

11) Further, the configuration of the inkjet head 4 does not need to be limited to that of the illustrative embodiment as shown in FIG. 5. For example, as shown in FIGS. 10A and 10B, on the surfaces of each of the metallic plates 31-38 to be bonded with a surface of another of the metallic plates 31-38, escape grooves to allow surplus adhesive agent to escape may be formed. It is noted that FIG. 10B is a partially enlarged view of a circled portion of the plate 38 in FIG. 10A. As shown in FIG. 10B, a surrounding area X of each of the multiple individual passage holes 38*c*, which are formed on the lower surface of the plate 38 to be bonded with the nozzle plate 39, a ring-like escape groove 55 is formed. Further, two adjacent ring-like grooves 55 are connected with a connecting groove 56. Although not shown, the similar escape grooves are formed on the other plates 31-37. When the plates 31-38 are bonded with the adhesive agent, by allowing the surplus adhesive agent to escape into the escape grooves 55, invasion of the surplus ink into the ink passages can be prevented. It is noted that the escape grooves 55 are not formed in the areas Y where the convex parts 53 are formed. Therefore, when the covering parts 54 of the nozzle plate 39 are whittled and the convex parts 53 are exposed, the escape grooves 55 are not exposed. Therefore, when the ink ejections surface 39*a* is wiped by the wiper 22 with the convex parts 53 being exposed, the ink will not collected inside the escape grooves 55.

The illustrative embodiment and its modifications described above are directed to the inkjet printer which ejects the ink drops to print an image and the like on the printing sheet. It is noted that the above configuration may also be applied to a liquid ejecting device which is used in other purposes other than printing of images. For example, the above-described configuration may be applied to a liquid ejecting device configured to eject conductive liquid onto a circuit substrate to form a conductive pattern on the surface of the circuit substrate.

What is claimed is:

1. A liquid ejecting device, comprising a fluid passage structure formed with multiple nozzles arranged in a particular nozzle arrangement direction and multiple passages respectively communicating with the multiple nozzles, wherein the fluid passage structure comprises a laminated body including a synthetic-resin nozzle plate formed with the multiple nozzles, the synthetic-resin nozzle plate being laminated and bonded to a metallic passage body that is formed with multiple individual passage parts communicating with the multiple nozzles of the liquid passages, wherein the laminated body has:

a liquid ejection surface on a first side of the nozzle plate which defines multiple ejection openings respectively corresponding to the multiple nozzles being formed;

a metallic plate of the metallic passage body laminated and bonded to a second side of the nozzle plate opposite the first side of the nozzle plate, the metallic plate including multiple convex parts forming multiple protective parts protruding from the liquid ejection surface, the multiple protective parts being arranged along the nozzle arrangement direction, beside the multiple ejection openings, respectively; and a liquid-repellent coat covering the liquid ejection surface including the multiple protective parts protruding from the liquid ejection surface, and wherein the convex parts forming the multiple protective parts are formed by press working applied to the laminated body from a passage body.

2. The liquid ejecting device according to claim 1, wherein a radius of curvature of apex portions of the multiple convex parts is equal to or more than 10 μm.

3. The liquid ejecting device according to claim 1, wherein the nozzle plate and the passage body are bonded with adhesive agent, and wherein an escape groove allowing the adhesive agent to escape on a second area of a nozzle plate side surface of the passage body which is different from the first area in which the convex part is formed.

4. The liquid ejecting device according to claim 3, wherein concave parts are formed on a surface of the passage body opposite to the nozzle plate, the portions of the passage body formed to be concave parts being the thin parts.

5. The liquid ejecting device according to claim 4, wherein the passage structure has a liquid chamber forming member formed with a common liquid chamber communicating with the multiple nozzles, wherein the surface of the passage body opposite to the liquid ejection surface is arranged to contact one wall of the liquid chamber forming member partitioning the common liquid chamber, and wherein a space is formed between the one wall of the liquid chamber forming member and the thin part of the passage body.

6. The liquid ejecting device according to claim 1, wherein the multiple nozzles are arranged in a particular nozzle arrangement direction, wherein the multiple convex parts formed on the passage body are arranged aside the multiple nozzles along the nozzle arrangement direction, each of the multiple convex parts having an elongated shape which is elongated in a direction parallel to a surface of the passage body, each of the multiple convex parts being arranged such that the elongated direction thereof being aligned with the nozzle arrangement direction.

7. The liquid ejecting device according to claim 1, wherein the passage body is made of a rolled member formed by a rolling process, and wherein the multiple nozzles are arranged along a rolling direction of the passage body.

8. The liquid ejecting device according to claim 1, wherein the nozzle plate is made of a rolled member formed by a rolling process, wherein the multiple protective parts are arranged along the nozzle arrangement direction and a direction orthogonal to the nozzle arrangement direction, wherein an arranged number of the multiple protective parts in the nozzle arrangement direction and an arranged number of the multiple protective parts in the direction orthogonal to the nozzle arrangement direction are different, and wherein one of the nozzle arrangement direction and the direction orthogonal to the nozzle arrangement direction in which the arranged number of the multiple protective parts is larger extends along the rolling direction of the rolled member.

9. The liquid ejecting device according to claim 1, wherein the passage body has thin parts which are parts of the passage body formed to be thin, and wherein the multiple protective parts are formed by applying the press working at the thin parts, and wherein the individual passage parts are formed on thick parts which is thicker than the thin parts of the passage body.

10. A method of manufacturing liquid ejecting device having a fluid passage structure formed with multiple nozzles arranged in a particular nozzle arrangement direction and multiple passages respectively communicating with the multiple nozzles, the method comprising:

providing a first plate which is made of synthetic resin and included in the fluid passage structure, the first plate being formed with the multiple nozzles and including a liquid ejection surface;

providing a second plate which is made of metallic material and included in the fluid passage structure, the second plate being formed with the multiple individual passage parts communicating with the multiple nozzles in the fluid passage;

laminating and bonding a surface of the first plate opposite the liquid ejection surface to a first surface of the second plate;

press working a second surface of the second plate opposite the first surface to form multiple protective parts on the laminated body of the first plate and the second plate such that the multiple protective parts protrude from the liquid ejection surface on which ejection openings of the multiple nozzles are arranged and are aligned along the nozzle arrangement direction, after the laminating process; and covering the liquid ejection surface and the multiple protective parts with a liquid-repellent coat.

11. The method of manufacturing the liquid ejecting device according to claim 10, wherein the method includes a thin part forming process of forming thin parts which are parts of the metallic plate formed to be thinner than other parts, and wherein the multiple protective parts are formed by applying the press working at the thin parts of the second plate.

12. The method of manufacturing the liquid ejecting device according to claim 10, wherein the protective part forming process forms each of the protective parts by pushing a punch into the second plate to the laminated body, wherein the punch has a tapered part formed at a tip portion of the punch and a straight part connected from the tapered part, and wherein only the tapered part is pushed in the laminated body and the straight part is not pushed in the laminated body in the convex part forming process.

13. The method of manufacturing the liquid ejecting device according to claim 10, wherein processing oil is not used when the press working is applied in the protective part forming process.

14. The method of manufacturing the liquid ejecting device according to claim 10, wherein the protective parts are formed by pushing in the punch to the second plate of the laminated body without providing a stripper to the second plate.

* * * * *